US007607943B2

(12) United States Patent
Kenjo

(10) Patent No.: US 7,607,943 B2
(45) Date of Patent: Oct. 27, 2009

(54) ELECTRIC CONNECTOR FOR CIRCUIT BOARD

(75) Inventor: Mitsunori Kenjo, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 44 days.

(21) Appl. No.: 11/992,652

(22) PCT Filed: Oct. 20, 2006

(86) PCT No.: PCT/JP2006/320900

§ 371 (c)(1),
(2), (4) Date: Mar. 27, 2008

(87) PCT Pub. No.: WO2007/046487

PCT Pub. Date: Apr. 26, 2007

(65) Prior Publication Data

US 2009/0233488 A1 Sep. 17, 2009

(30) Foreign Application Priority Data

Oct. 21, 2005 (JP) ..... 2005-307101

(51) Int. Cl.
*H01R 9/05* (2006.01)

(52) U.S. Cl. ..... 439/579

(58) Field of Classification Search ..... 439/579, 439/497, 74, 493, 108, 607.34, 607.35, 607.36
See application file for complete search history.

(56) References Cited

U.S. PATENT DOCUMENTS 5,975,916 A * 11/1999 Okura ..... 439/74
6,623,308 B2 * 9/2003 Ono ..... 439/680
6,692,266 B2 * 2/2004 Hashiguchi et al. ..... 439/74
6,830,478 B1 * 12/2004 Ko ..... 439/579
7,118,388 B2 * 10/2006 Midorikawa et al. ..... 439/74
7,134,907 B2 * 11/2006 Watanabe et al. ..... 439/495

(Continued)

FOREIGN PATENT DOCUMENTS

JP 2003-163054 6/2003

*Primary Examiner*—T C Patel
*Assistant Examiner*—Vladimir Imas
(74) *Attorney, Agent, or Firm*—Kubotera & Associates, LLC

(57) ABSTRACT

A fitting portion 21 of a terminal 20 is formed in an inverted U character shape along an outer surface and an upper surface of a housing sidewall portion and an interior of a receptacle groove 16; an elastic arm portion 22 bends and extends from the fitting portion to form a U character shape; the bent portion reaches a bottom portion 14B of the receptacle groove in a connector fitting direction; the elastic arm portion extends upward inside the receptacle groove from the bent portion and has elasticity in an area up to a free edge; the elastic arm portion has a contact portion 22A slightly protruding from the inner side surface 14C of the fitting recess portion; the fitting recess portion 14 forms a space between the inner side surface and an opposite inner side surface for receiving a fitting contact portion of the mating connector; the fitting contact portion of the mating connector presses the contact portion 22A of the terminal toward inside the receptacle groove 16; and a distal portion of the fitting contact portion in a connector fitting direction enters toward a bottom portion of the fitting recess portion up to a position substantially the same as that of the bent portion of the terminal.

1 Claim, 7 Drawing Sheets

U.S. PATENT DOCUMENTS 7,195,494 B2 * 3/2007 Ookura ..... 439/74
7,207,842 B1 * 4/2007 Kenjo ..... 439/607.01
7,367,816 B2 * 5/2008 Liu ..... 439/74
7,377,803 B2 * 5/2008 Matsuoka ..... 439/497
7,425,158 B2 * 9/2008 Ookura ..... 439/660
7,465,186 B2 * 12/2008 Yotsutani ..... 439/497
7,497,697 B2 * 3/2009 Hoshino et al. ..... 439/74
2005/0181661 A1 * 8/2005 Kaneko et al. ..... 439/427
2006/0183358 A1 * 8/2006 Iida et al. ..... 439/74
2006/0234525 A1 * 10/2006 Ookura ..... 439/74
2007/0093085 A1 * 4/2007 Kenjo ..... 439/74
2007/0105408 A1 * 5/2007 Ookura ..... 439/74

* cited by examiner

ELECTRIC CONNECTOR FOR CIRCUIT BOARD

FIELD OF THE INVENTION

The present invention relates to an electrical connector to be attached to a circuit board in use.

DESCRIPTION OF THE RELATED ART

A connector disclosed in FIG. 7 has been known as a connector of this type.

In a connector 50 shown in FIG. 7, a receptacle groove 52 with an upward opening and a bottom wall 52A is provided in a housing 51 and retains a part of a terminal 53. The receptacle groove 52 opens upward. Further, a top portion of a sidewall portion 54 of the housing 51 is cut off, and there is an opening on this side. This receptacle groove 52 is sized to have a width of the terminal 53 that is bent and has a band shape. That is, the width in a direction perpendicular to a sheet surface is determined.

The terminal 53 having a band shape has a substantially S character shape; that is, continuously a U character shape portion and an inverted U character shape portion. An elastic arm portion 53A is provided in the U character shape portion, and a fitting portion 53B is provided in the inverted U character shape portion. The fitting portion 53B is fitted into the sidewall portion 54 from above. Further, a connecting portion 53C is provided to connect with the fitting portion 53B outside the housing and contact with a circuit board. Further, a distal side of the elastic arm portion 53A is partially bent inside the receptacle groove 52, thereby forms a contact portion 53A1.

The elastic arm portion 53A has a lower portion 53A2 that is adjacent to and follows the bottom wall 52A of the receptacle groove 52. Further, the lower portion 53A2 largely spreads inside the receptacle groove 52 to receive a fitting contact portion 61 of a mating connector inside the U character shape thereof. Thus, the contact portion 53A1 formed to be bent in the distal portion of the elastic arm portion 53A is to elastically contact with the fitting contact portion 61.

The fitting contact portion 61 of the mating connector enters up to an immediate upper position of the lower portion 53A2 of the elastic arm portion 53A.

Further, in the Patent Reference 1, similar to the configuration of FIG. 7 described above, as indicated by a phantom line A in FIG. 7, the receptacle groove 52 pass through to the bottom portion to remove the bottom wall 52A. Further, the terminal 53 is positioned further downward.

Patent Reference 1: Japanese Patent Publication No. 2003-163054

DISCLOSURE OF THE INVENTION

Problem to be Solved

A width direction size of the connector of this type is not an important issue. However, a lengthwise direction size of such connector; that is, a height of the connector on the circuit board is demanded to be minimized. This is to reduce a size of an electrical device that is configured through piling a plurality of the circuit boards of the similar type.

However, in the connector described above and shown in FIG. 7, a fitting contact portion of the mating connector is positioned above the U character shape elastic arm portion of the terminal of the connector arranged on the circuit board.

Accordingly, the lower portion of the elastic arm portion and the lower portion of the fitting contact portion are overlapped in a top-to-bottom direction; thereby a height direction of the connector is enlarged.

On the other hand, in Patent Reference 1, a housing bottom wall that forms a receptacle groove bottom portion is removed to have a receptacle groove pass through downward; thereby a terminal is lowered downward. Accordingly, a height of the connector can be reduced. However, by doing this, the terminal becomes directly close to a surface of the circuit board. If there is a circuit portion that is not related to the terminal in a corresponding area of the circuit board, the terminal can be short-circuited with the circuit portion for some reasons. Accordingly, the connector of Patent Reference 1 is used without providing a circuit portion in the corresponding area of the circuit board. This causes an inconvenience that limits designing of the circuit board.

An objective of the present invention is to provide an electrical connector to be attached to a circuit board that has a small height without causing the inconvenience described above.

Solution to the Problem

The present invention relates to an electrical connector to be attached to a circuit board, wherein a fitting recess portion with a bottom portion extends in a longitudinal direction of a housing and opens upward for receiving a mating connector; and a contact portion of a terminal is arranged on an inner side surface of the fitting recess portion in a longitudinal direction thereof for connecting with a mating terminal.

According to the present invention, the electrical connector is characterized in that the housing includes a receptacle groove recessed from the inner side surface in a housing sidewall portion forming the inner side surface for retaining an elastic arm portion of the terminal, the receptacle groove being arranged from an opening position to a bottom portion position of the fitting recess portion; the terminal includes a fitting portion fitted into the housing sidewall portion from above, a connecting portion connected to the fitting portion and extending from an outer surface position of the housing sidewall portion to a position to contact with the circuit board, and the elastic arm portion extending from the fitting portion toward inside the fitting recess portion; the fitting portion is formed in an inverted U character shape along an outer surface and an upper surface of the housing sidewall portion and an interior of the receptacle groove; the elastic arm portion bends and extends from the fitting portion to form a U character shape, and a bent portion thereof reaches a bottom portion of the receptacle groove in a connector fitting direction; the elastic arm portion extends upward inside the receptacle groove from the bent portion, having elasticity in an area up to a free edge thereof, and having the contact portion slightly protruding from the inner side surface of the fitting recess portion; the fitting recess portion forms a space between the inner side surface and an opposite inner side surface for receiving a fitting contact portion of the mating connector; when the connector is fitted, the fitting contact portion of the mating connector presses the contact portion of the terminal toward inside the receptacle groove, and a distal portion of the fitting contact portion in a connector fitting direction enters toward a bottom portion of the fitting recess portion up to a position substantially the same as that of the bent portion of the terminal; and the terminal includes a sub contact portion in at least a part of an area in which the fitting portion extends along the outer surface of the housing sidewall portion, and when the connector is fitted, the sub contact portion contacts with a corresponding portion of the mating terminal.

According to the present invention, the terminal of the connector of the present invention and the terminal of the mating connector are positioned next to each other inside the receptacle groove, and thereby do not overlap each other. The both terminals can near the housing bottom wall in the same level inside the receptacle groove. Accordingly, a height of the connector when fitted into the mating connector is to be small.

As previously described, according to the present invention, the terminal inside the terminal receptacle groove and the mating terminal do not overlap each other in the height direction. Accordingly, the height of the connector can be reduced, which contributes to provide a low-profile connector.

DETAILED DESCRIPTION OF PREFERRED EMBODIMENTS

Hereunder, an electrical connector for a circuit board according to an embodiment of the present invention will be explained with reference to the accompanying drawings, i.e., FIGS. 1 to 6.

Figure 1:
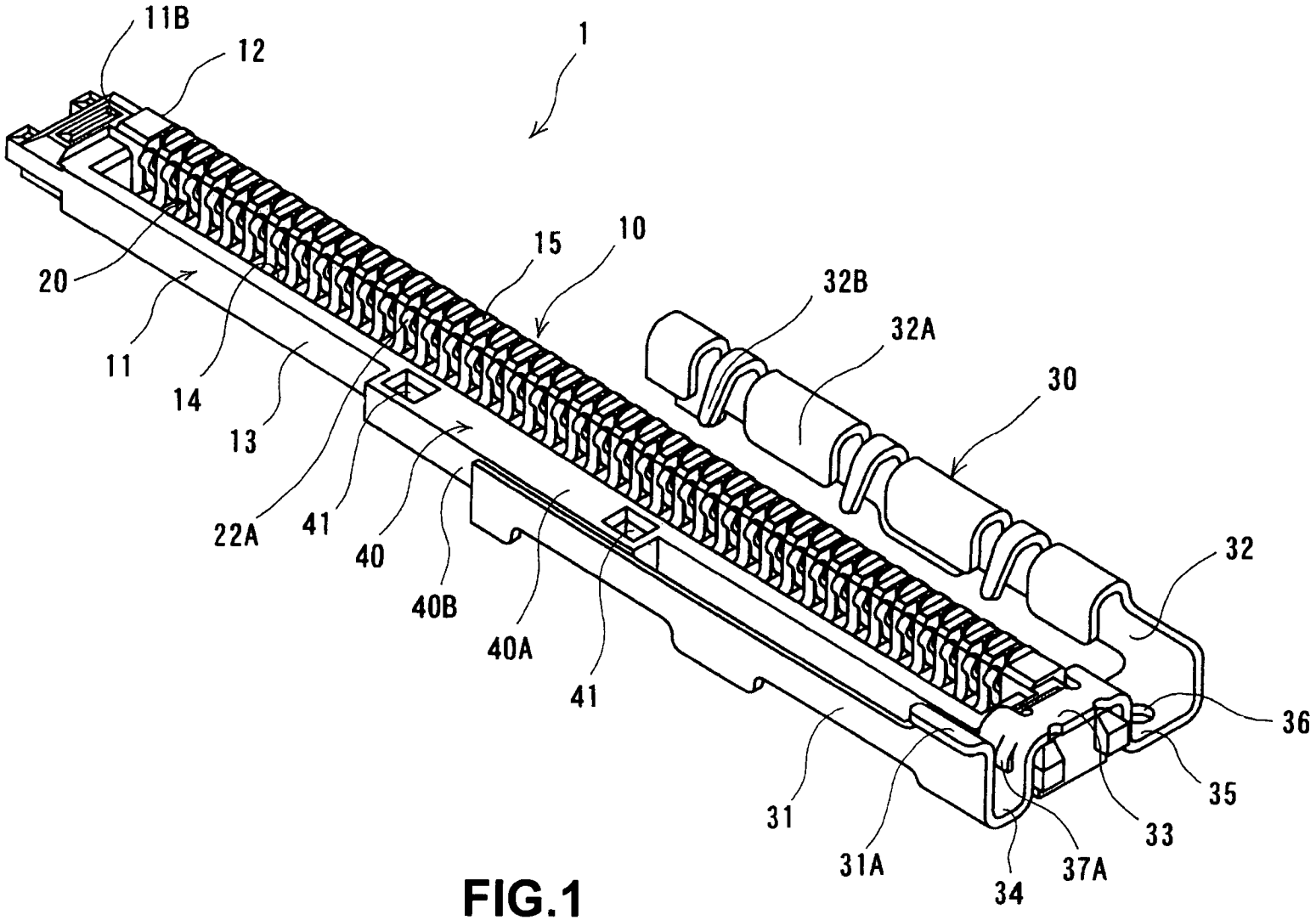
FIG. 1 is a perspective view showing connector with a ground plate according to an embodiment of the present invention, in which a left half of the ground plate in a longitudinal direction of the connector is omitted.
Figure 2:
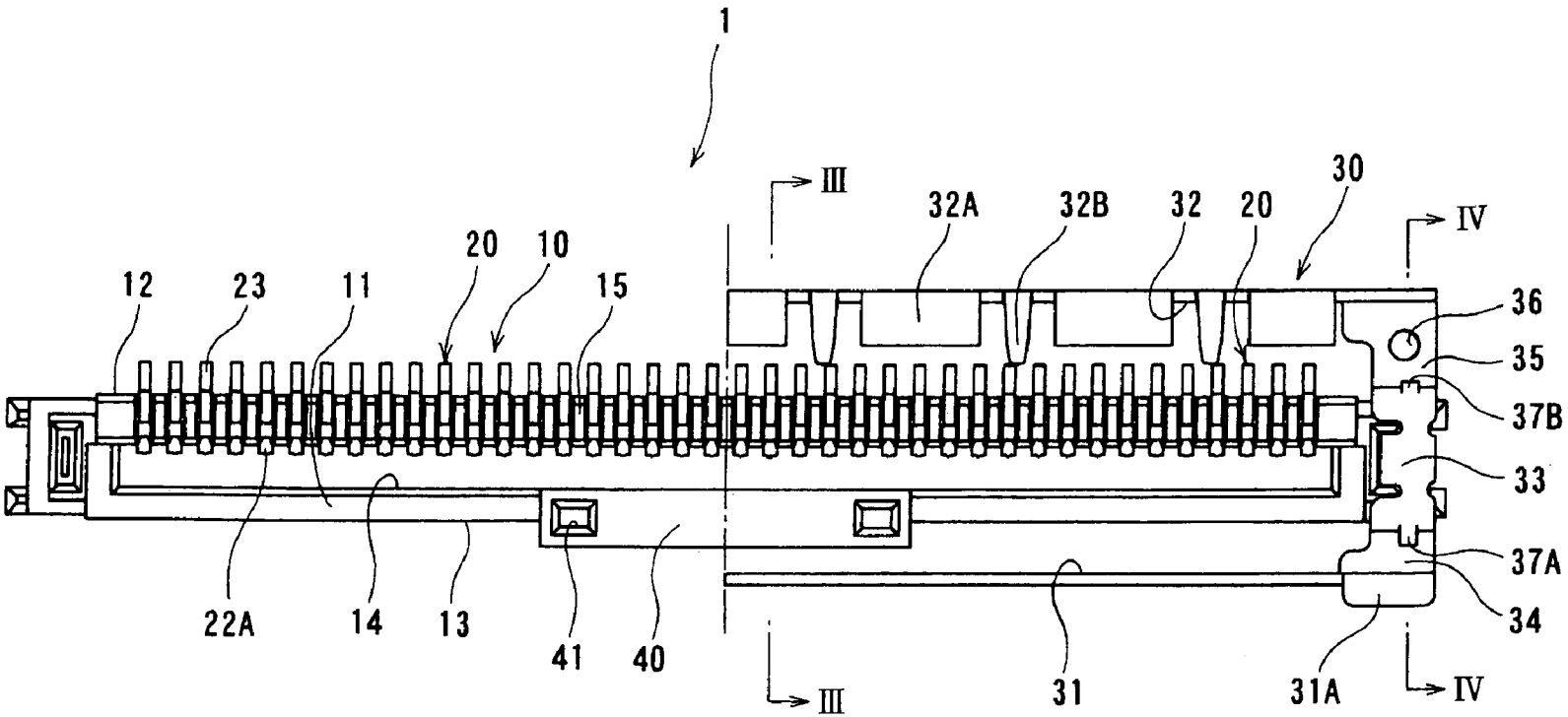
FIG. 2 is a plan view of the electrical connector shown in FIG. 1, in which, similar to FIG. 1, the left half of the ground plate in the longitudinal direction of the connector is omitted.

FIG. 1 is a perspective view showing a whole configuration of the connector according to the embodiment, and FIG. 2 is a plan view thereof. In both figures, a left half of a ground plate attached to the connector is omitted in the longitudinal direction.

A connector 1 is formed to attach to a circuit board (not shown), and extends in left and right directions as shown in the figures. In the connector 1, a ground plate 30 is selectively attached to a connector main body 10.

In the connector main body 10, a plurality of terminals 20 is arranged with a specific interval on an outer side surface 12 among the outer side surfaces 12 and 13 situated in a longitudinal direction of a housing 11 formed of an insulation material and elongated in the left and right directions.

Figure 3:
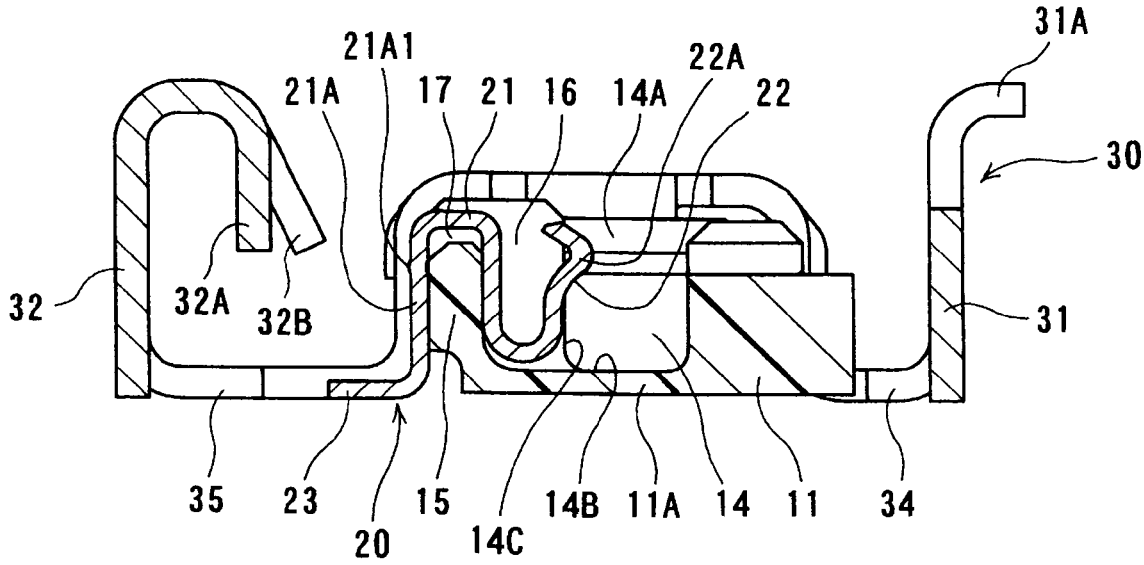
FIG. 3 is a sectional view taken along a line III-III in FIG. 2.

The housing 11 is provided with a fitting recess portion 14 opening upward and extending up to both ends in the longitudinal direction. Among surrounding walls forming the fitting recess portion 14, the terminals 20 are arranged on one sidewall portion 15 extending in the longitudinal direction. The fitting recess portion 14 is situated at a center portion in a width direction, i.e., a direction perpendicular to the longitudinal direction. As shown in FIG. 3, i.e., a sectional view taken along a line III-III in FIG. 2, the fitting recess portion 14 is formed deep to an extent that a thin bottom wall 11A remains in the housing 11. The fitting recess portion 14 is provided with receptacle grooves 16 at positions corresponding to the terminals recessing from an inner side surface 14C of the one sidewall portion 15 over a vertical range from a position of an upper opening 14A to a bottom portion 14B or an upper surface of the bottom wall 11A. The receptacle grooves 16 have a depth deep enough for receiving almost whole portion of elastic arms of the terminals (described later). Shallow grooves 17 communicating with the receptacle grooves 16 are formed in an upper end surface and an outer side surface of the sidewall portion 15.

The terminals 20 to be attached to the housing 11 with the receptacle grooves 16 and the grooves 17 are formed of metal thin plates bent relative to a plate surface. As shown in FIG. 3, a sectional shape taken along a plane perpendicular to the plate surface is a substantially S character shape. The terminal has continuously an inverted U character shape portion and a U character shape portion, thereby having a substantially S character shape as a whole. As shown in FIG. 3, the terminal 20 has a fitting portion 21 having an inverted U character shape; an elastic arm portion 22 having a U character shape and connected thereto; and a connecting portion 23 extending from a lower end portion of the fitting portion 21.

The fitting portion 21 is pressed and fitted into the receptacle groove 16 from above, so that the terminal 20 is fixed to the housing 11. The connecting portion 23 bent laterally and extending from the lower end of the fitting portion 21 outside the housing 11 is situated at a level same as that of a bottom surface of the housing 11. When the connector is installed on the circuit board, the connecting portion 23 contacts with the corresponding circuit portion of the circuit board.

The elastic arm portion 22 is bent and extends upward from a lower portion of the fitting portion 21 fitted into the receptacle groove 16, and has elasticity with this flexible portion. The elastic arm portion 22 is provided at an upper end or a free end thereof with a contact portion 22A curved in a state protruded toward outside the receptacle groove 16. The contact portion 22A slightly protrudes from the inner side surface 14C toward inside the fitting recess portion 14. When the mating connector is fitted into the fitting recess portion 14, the contact portion 22A is pushed with the mating connector to elastically deform to a position of the inner side surface 14C toward inside the receptacle groove 16.

The terminal 20 slightly projects from an opening edge of the groove 17 at a portion thereof where the fitting portion 21 is retained in the groove 17 to form a sub-contact portion 21A. In a preferred configuration, a projection 21A1 is formed for securing contact with the mating connector and functioning as lock.

Figure 4:
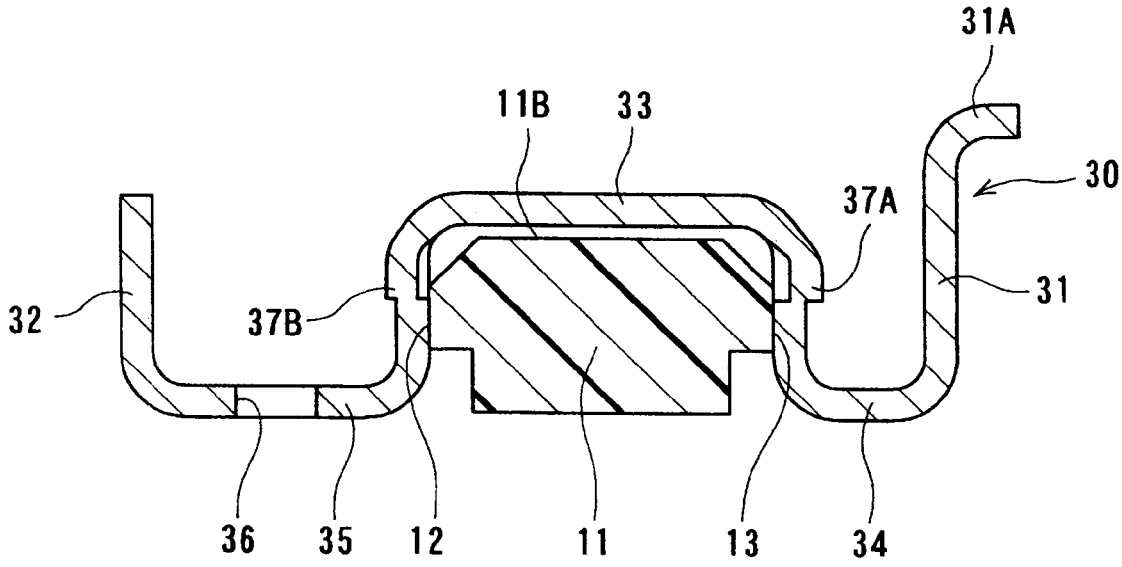
FIG. 4 is a sectional view taken along a line IV-IV in FIG. 2.

As shown in FIG. 4, i.e., the sectional view taken along the line IV-IV in FIG. 2, the housing 11 has ground plate attaching portions 11B at both end portions thereof in the longitudinal direction. The ground plate 30 to be attached to the ground plate attaching portions 11B is formed of one metal plate punched and bent. As shown in FIGS. 1 and 2, the ground plate 30 has ground main portions 31 and 32 situated along the outer side surfaces 12 and 13 of the housing 11, and connecting members 34 and 35 for connecting the ground main portions 31 and 32 to an attaching portion 33. The connecting members 34 and 35 link lower portions of the attaching portions 33 to be attached to the ground plate attaching portions 11B and lower portions of the ground main portions 31 and 32, so that the connecting members 34 and 35 contact with the circuit board at the both end portions of the housing 11 in the longitudinal direction. In the embodiment, the connecting member 35 has an attaching hole 36.

The ground main portion 31 has a surface substantially in parallel to the other outer side surface 13 of the housing 11 with a distance from the outer side surface 13. An upper edge of the ground main portion 31 is situated at a level same as that of an upper surface of the housing 11. The ground main portion 31 has curved projecting portions 31A projecting upward from the upper edge of the ground main portion 31 at only both end portions thereof in the longitudinal direction. Accordingly, when the mating connector is fitted, the upper edge of the ground main portion 31 does not interfere with a cable horizontally extending from the mating connector at a side of the ground main portion 31. That is, since the upper edge is situated at the position of the upper surface of the housing 11, the cable is allowed to extend at the upper position. However, in order to further improve shielding effect of the ground plate, a cut portion may be formed only at a position where the cable extends, and the upper edge may be extend upward, for example, the curved projecting portion may be formed over a whole range in the longitudinal direction except a position of the cut portion.

Similar to the ground main portion 31, the ground main portion 32 has a surface substantially in parallel to the outer side surface 12 of the housing 11 with a distance from the outer side surface 12. It is arranged such that the distance becomes greater than the distance in the case of the ground main portion 13. The connecting portions 23 of the terminals 20 are situated between the ground main portion 32 and the outer side surface 12 of the housing 11. The ground main portion 32 and the attaching portions 33 are connected with the connecting members 35 at both end portions in the longitudinal direction where the terminals are not disposed. Accordingly, the ground main portion 32 is apart from the attaching portions 33 to form a space in between, so that the connecting portions 23 are able to contact with the corresponding circuit portion of the circuit board. The ground main portion 32 has two types of curved portions 32A and 32B at an upper edge thereof curved toward inside (the housing side) and arranged alternately in the longitudinal direction. One of the curved portions 32A has a wide width, and the other of the curved portions 32B has a narrow width. The other of the curved portions 32B extends obliquely toward inside further than one of the curved portions 32A to form an elastic tongue piece. The elastic tongue piece forms a contact section for elastically contacting with a mating ground plate when fitted into the mating connector.

As shown in FIG. 4, the attaching portions 33 have an inverted U character shape to be fitted into the ground plate attaching portions 11B provided at the both end portions of the housing 11. Outer surfaces of the attaching portions 33 function as portions where corresponding engaging portions of the mating connector are fitted into from above for engagement. The attaching portion 33 has lock portions on outer surface at both shoulder portions thereof. The lock portions are formed of projections, and include a main lock portion 37A situated at a side where the cable of the mating connector extends and a sub lock portion 37B situated at an opposite side. The main lock portion 37A projects for an amount greater than that of the sub lock portion 37B. That is, the main lock portion 37A engages the corresponding lock portion of the mating connector to a greater extent. A difference in the amount of projection is set in proportion of force received from the mating connector when the mating connector is detached by lifting the cable.

The housing 11 has an absorption portion 40 at a center position in the longitudinal direction of the housing 11 on the side of the other outer side surface 13. The absorption portion 40 forms a portion to be absorbed by an absorption portion of an automated device when the automated device mounts the connector to a specific position on the circuit board. An upper surface 40A is flush with the upper surface of the housing and projects in the width direction of the housing. A side surface 40B of the projecting absorption portion 40 is close to the ground main portion 31. Attaching holes 41 are formed in the upper surface of the absorption portion 40 at both end positions in the longitudinal direction for attaching an auxiliary attaching member. When it is difficult to cope with the automated device only with the upper surface 40A of the absorption portion 40, the auxiliary attaching member is attached to the attaching holes 41 for enlarging an attaching surface. It is preferred that the absorption portion 40 is provided within a width of the mating connector.

Figure 6:
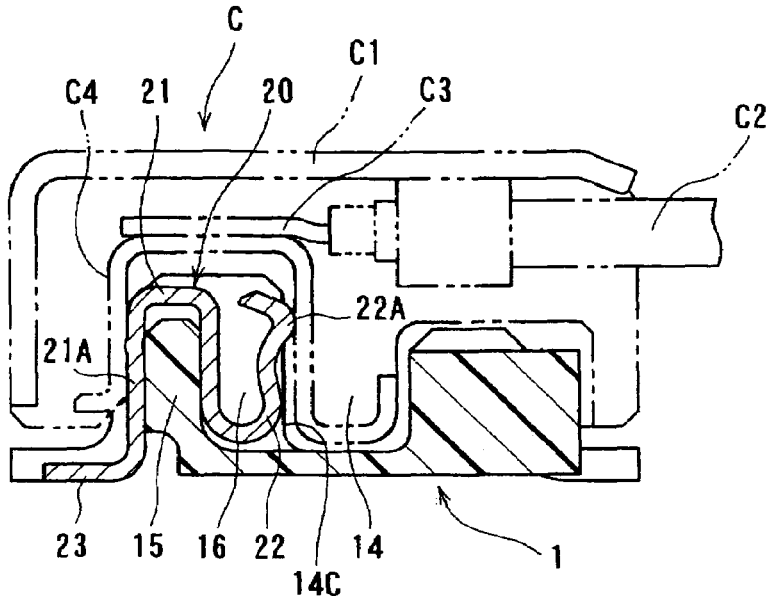
FIG. 6 is a sectional view of the electrical connector shown in FIG. 1 at a position of a terminal when the connector is fitted into the mating connector, wherein (A) shows a state without the ground plate, and (B) shows a state with the ground plate.
Figure 6:
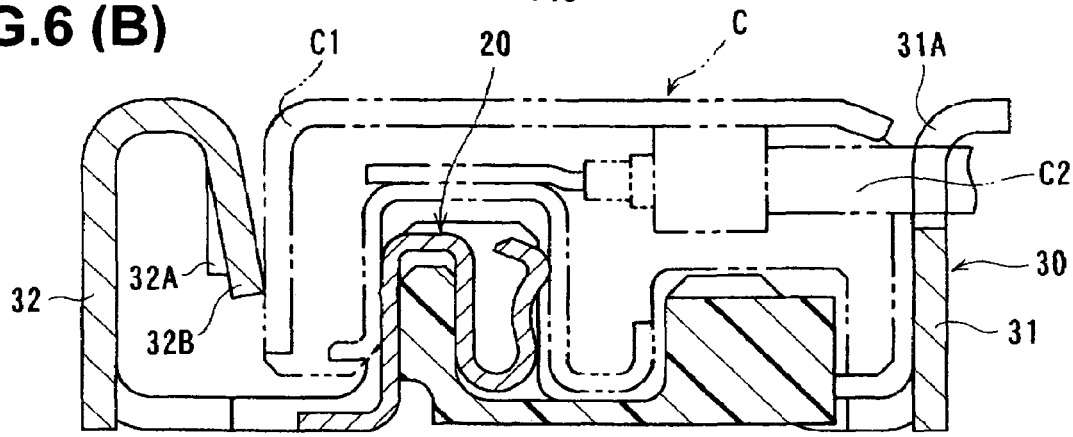
Figure 7:
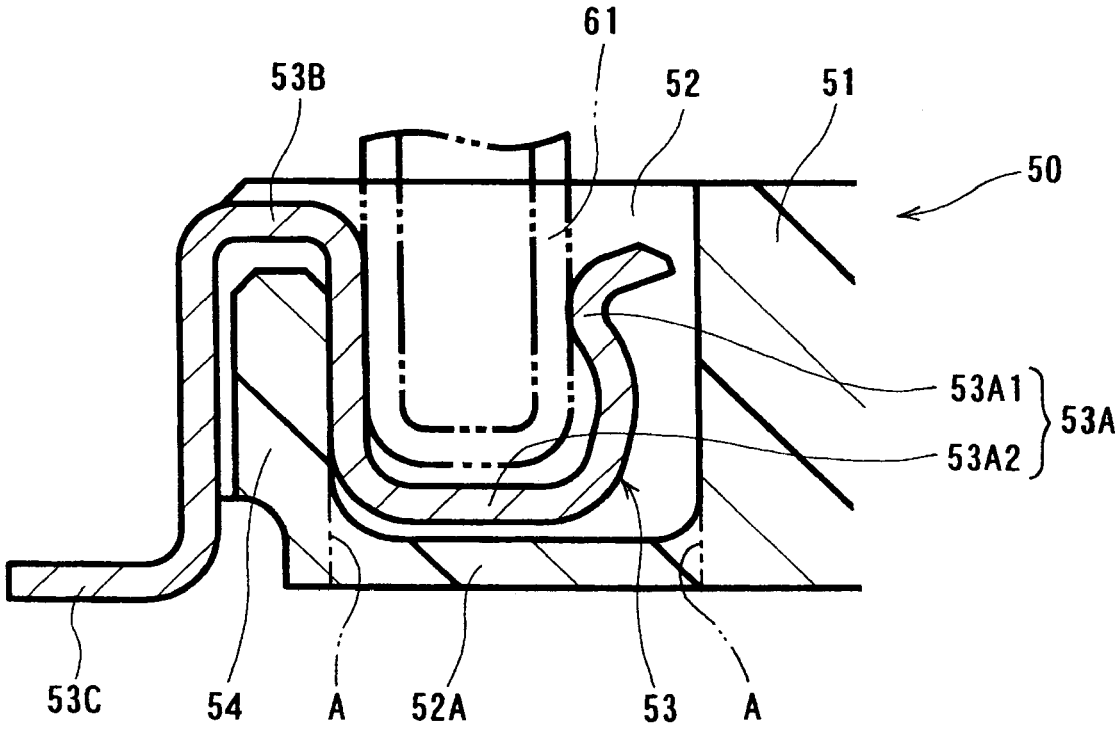
FIG. 7 is a sectional view of a conventional connector.

The mating connector to be fitted into the connector of the embodiment has a configuration shown in FIG. 6. FIG. 6 is a view showing a use state of the connector of the embodiment fitted into the mating connector, wherein FIG. 6(A) shows a state that the connector of the embodiment is used without the ground plate, and FIG. 6(B) shows a state used with the ground plate.

As shown in FIG. 6(A), a mating connector C with a cable indicated by phantom lines has a coaxial cable C2 held between an insulation member and a part of the ground plate C1 and extending laterally in the right direction. A center conductor C3 of the coaxial cable C2 is connected to a terminal C4. The terminal has an inverted U character shape portion and a U character shape to form a substantially S character shape as a whole. The ground plate C1 is attached to an outer side of the connector. The ground plate C1 covers an upper surface of the connector and an outer side surface except a side surface on a side where the cable extends. The mating connector C receives the terminal 20 of the connector of the embodiment inside the inverted U character shape portion of the terminal C4, and the U character shape portion enters the fitting recess portion 14 of the connector of the embodiment.

The connector of the embodiment is used in the following manner.

First, the absorption portion of the automated device absorbs the connector 1 at the absorption portion 40 (absorption surface 40A) of the connector 1, and moves the connector 1 to a specific position on the circuit board. Afterward, the connecting portions 23 of the terminals are connected to the corresponding circuit portions of the circuit board with solder. It is possible to use the connector 1 in the state that the ground plate 30 is attached or in the state that there is no ground plate (only the portion where the ground plate of the mating connector is connected to the board). It is possible to attach the ground plate 30 before or after the connector is arranged on the circuit board. When the ground plate 30 is used, it is preferable to fix with solder at the attaching holes 36 shown in FIG. 4.

Next, as shown in FIGS. 6(A) and 6(B), the mating connector C is fitted into the connector 1. The terminals C4 of the mating connector C contact with the terminals 20 of the connector 1 while surrounding in the inverted U character shape portion. That is, one of straight portions of the inverted U character shape portion of the terminal C4 contacts with the sub contact portion 21A of the terminal 20 of the connector 1, and an opposite straight portion elastically presses the contact portion 22A. The contact portion 22A is pushed into the receptacle groove 16. The U character shape portion of the terminal C4 of the mating connector enters up to a bottom portion of the fitting recess portion 14. That is, the U character shape portion of the terminal C4 enters downward up to a position substantially same as the elastic arm portion 22 of the terminal of the connector 1. As a result, the straight portion contacting with the contact portion 22A has a long contact length during the fitting process, and it is possible to minimize heights of the both connectors upon fitting.

When the connector 1 is provided with the ground plate 30, as shown in FIG. 6(B), the ground main portions 31 and 32 cover the connector 1 sideways over a large range extending in the longitudinal direction of the connector 1. The ground plate C1 of the mating connector C covers the upper portion of the both connectors C and 1. In the ground plate 30 of the connector 1, the contact sections 32B formed as the elastic tongue pieces contact with the ground plate C1 of the mating connector C, thereby mutually conducting at the positions.

The cable C2 extending from the mating connector C is drawn through above the upper edge of the ground main portion 31 without interference with the ground plate.

Figure 5:
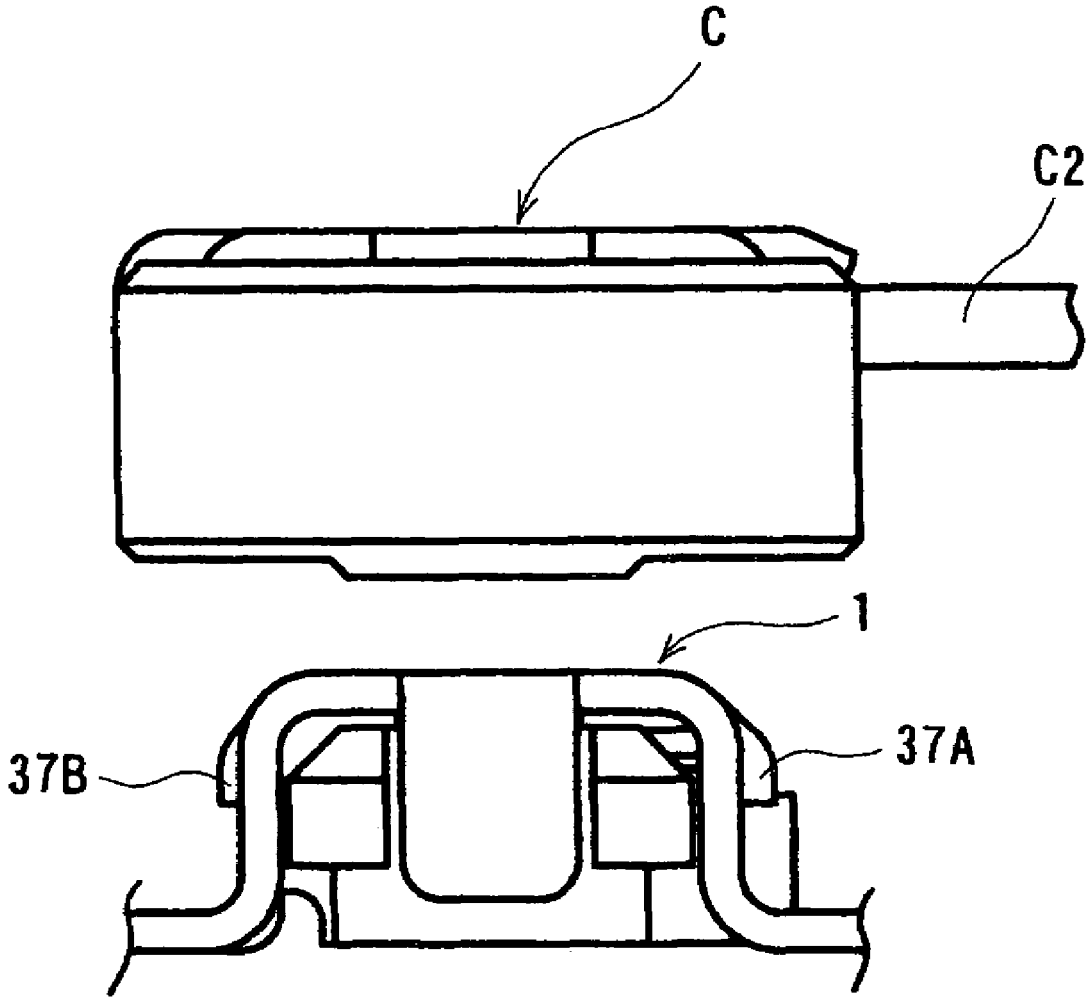
FIG. 5 is a side view of the electrical connector shown in FIG. 1 together with a mating connector.

In the mating connector C, the lock portions (not shown) engage the lock portions 37A and 37B with the projecting shape, so that the connectors are not separated inadvertently. When the cable C2 inadvertently receives upward force, the lock portion 37A close to the cable C2 receives force larger than that of the opposite lock portion 37B as shown in FIG. 5. However, since the lock portion 37A engages to a larger extent than the lock portion 37B, it is possible to properly prevent the connector from coming off according to the balance of force.

When the mating connector C is detached, it is preferred to detach with a tool from the side of the lock portion 37B. In the present invention, the lock portions 37A and 37B are provided at the both end portions of the ground plate 30 in the longitudinal direction, and may be provided on the housing 11. It is preferred that the lock portion of the mating connector is provided on the mating ground plate, so that the lock portion contacts to the lock portions 37A and 37B provided on the ground plate 30.

INDUSTRIAL APPLICABILITY

The electrical connector to be attached to a circuit board according to the present invention can be used in an electric device which requires minimizing a height on the circuit board when mounted to the circuit board.

The invention claimed is:

1. An electrical connector to be attached to a circuit board, comprising:

a fitting recess portion with a bottom portion extending in a longitudinal direction of a housing and opens upward for receiving a mating connector; and a contact portion of a terminal arranged on an inner side surface of the fitting recess portion in a longitudinal direction thereof, wherein said housing includes a receptacle groove recessed from the inner side surface in a housing sidewall portion forming the inner side surface for retaining an elastic arm portion of the terminal, the receptacle groove being arranged from an opening position to a bottom portion position of the fitting recess portion;

said terminal includes a fitting portion fitted to the housing sidewall portion from above; a connecting portion connected to the fitting portion and extending from an outer surface position of the housing sidewall portion to a position to contact with the circuit board; and the elastic arm portion extending from the fitting portion toward inside the fitting recess portion;

said fitting portion is formed in an inverted U character shape along an outer surface and an upper surface of the housing sidewall portion and an interior of the receptacle groove;

said elastic arm portion bends and extends from the fitting portion to form a U character shape, and a bent portion thereof reaches a bottom portion of the receptacle groove in a connector fitting direction;

said elastic arm portion extends upward inside the receptacle groove from the bent portion, having elasticity in an area up to a free edge thereof, and having the contact portion slightly protruding from the inner side surface of the fitting recess portion;

said fitting recess portion forms a space between the inner side surface and an opposite inner side surface for receiving a fitting contact portion of the mating connector;

when the connector is fitted, the fitting contact portion of the mating connector presses the contact portion of the terminal toward inside the receptacle groove, and a distal portion of the fitting contact portion in a connector fitting direction enters toward a bottom portion of the fitting recess portion up to a position substantially the same as that of the bent portion of the terminal; and the terminal includes a sub contact portion in at least a part of an area in which the fitting portion extends along the outer surface of the housing sidewall portion, and when the connector is fitted, the sub contact portion contacts with a corresponding portion of the mating terminal.

* * * * *